US006500606B2

(12) United States Patent
Price et al.

(10) Patent No.: US 6,500,606 B2
(45) Date of Patent: Dec. 31, 2002

(54) PHOTOGRAPHIC PROCESSING COMPOSITIONS AND METHODS OF USING IN COLOR REVERSAL IMAGE FORMATION

(75) Inventors: Harry J. Price, Webster, NY (US); Michael P. Youngblood, Rochester, NY (US); Ramanuj Goswami, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/782,574

(22) Filed: Feb. 13, 2001

(65) Prior Publication Data

US 2002/0182548 A1 Dec. 5, 2002

(51) Int. Cl.[7] ..... G03C 7/42

(52) U.S. Cl. ..... 430/461; 430/379; 430/427; 430/432

(58) Field of Search ..... 430/461, 379, 430/427, 432

(56) References Cited

U.S. PATENT DOCUMENTS 4,033,771 A * 7/1977 Borton et al.
4,839,262 A 6/1989 Schwartz ..... 430/379
4,921,779 A 5/1990 Cullinan et al. ..... 430/379
5,037,725 A 8/1991 Cullinan et al. ..... 430/372
5,043,253 A * 8/1991 Ishikawa ..... 430/493
5,523,195 A 6/1996 Darmon et al. ..... 430/393
5,837,432 A 11/1998 Buongiorne et al. ..... 430/379
5,948,604 A 9/1999 Craver et al. ..... 430/458
6,153,365 A 11/2000 Goswami et al. ..... 430/455
6,395,461 B1 * 5/2002 Goswami et al. ..... 430/460

* cited by examiner

*Primary Examiner*—Hoa Van Le
(74) *Attorney, Agent, or Firm*—J. Lanny Tucker

(57) ABSTRACT

A photographic prebleaching or conditioning composition is useful for providing color positive images in color reversal photographic materials. This composition includes at least 0.0001 mol/l of a cyclic mercapto bleach accelerating agent and at least 0.0001 mol/l of a water-soluble or water-dispersible 2,6-diarylaminotriazine or diaminostilbene dye stain reducing agent. The amounts of the dye stain reducing agent and bleach accelerating agents are determined according to the following equation:

[bleach accelerating agent, mol/l]≧0.01−10[dye stain reducing agent, mol/l].

25 Claims, No Drawings

PHOTOGRAPHIC PROCESSING COMPOSITIONS AND METHODS OF USING IN COLOR REVERSAL IMAGE FORMATION

FIELD OF THE INVENTION

This invention relates to novel photographic processing compositions. In particular, it relates to novel photographic prebleaching and conditioning compositions that are useful in the processing of color reversal photographic materials. This invention is useful in the photographic industry.

BACKGROUND OF THE INVENTION

The conventional image-forming process of silver halide photography includes imagewise exposure of a photographic silver halide recording material to actinic radiation (such as visible light), and the eventual manifestation of a useable image by wet photochemical processing of that exposed material. A fundamental step of photochemical processing is the treatment of the material with one or more developing agents to reduce silver halide to silver metal. With black-and-white photographic materials, the metallic silver usually comprises the image. With color photographic materials, the useful image consists of one or more organic dye images produced from an oxidized color developing agent formed wherever silver halide is reduced to metallic silver.

To obtain useful color images, it is usually necessary to remove all of the silver from the photographic element after color development. This is sometimes known as "desilvering". Removal of silver is generally accomplished by oxidizing the metallic silver, and then dissolving it and undeveloped silver halide with a "solvent" or fixing agent in what is known as a fixing step. Oxidation is achieved using an oxidizing agent, commonly known as a bleaching agent. For some processing methods, these two functions can be performed in the same processing step in what is known as bleach-fixing.

Color reversal photographic silver halide materials can be used to provide "positive" color images. One commercially important process intended to provide these positive color images in such materials uses the following sequence of processing steps: first development (using black-and-white silver developer), washing, reversal bath, color development (to provide a dye image), bleaching, fixing, washing, and stabilizing as described in U.S. Pat. No. 4,786,583 (Schwartz). Another useful process has the same steps, but stabilizing is carried out between color development and bleaching.

In such photographic processes, a bleach-accelerator bath is often used between the color development and bleaching steps. The bleach-accelerator bath is also known as a "conditioning" bath or solution. It is used to "condition" the metallic silver developed in the two developing steps, for complete oxidation to silver halide and to help preserve the acidity of the bleaching solution by reducing carryover of color developer into the bleaching solution. Where the "conditioning" solution contains an effective amount of a bleach accelerating agent, the solution is also known as a "prebleaching" solution. The bleach accelerating agent is imbibed into the emulsion layers of the color reversal photographic material during treatment with the prebleaching solution, and is accordingly present to exert its intended effect when the material is put into the bleaching solution.

Thus, the color reversal photochemical processing methods can include the use of a "conditioning" composition, a "prebleaching" composition, or both.

Conventional color reversal processing is also known from U.S. Pat. No. 4,921,779 (Cullinan et al), U.S. Pat. No. 4,975,356 (Cullinan et al), and U.S. Pat. No. 5,037,725 (Cullinan et al) as well as the conventional Process E-6 procedure using color reversal processing chemicals that can be obtained from Eastman Kodak Company (Rochester, N.Y.). Such processes include the use of a prebleaching composition that generally includes a formaldehyde precursor (such as sodium formaldehyde bisulfite, hexamethylenetetramine, or various methylol compounds) and various bleach accelerating agents such as aliphatic thiols including thioglycerol.

Another function of some prebleaching or conditioning compositions is that they may also contain dye stain reducing agents or dye stabilizers to provide image stability when certain spectral sensitizing dyes are retained in processed materials, as described for example in U.S. Pat. No. 6,153,365 (Goswami et al.).

One disadvantage of some aliphatic thiol bleach accelerating agents is that they readily react with oxygen in air and thus the prebleaching compositions have limited storage or shelf stability as well as reduced activity in the processing equipment. Over extended exposure to air in the processing equipment, the compositions lose their "activity" or ability to accelerate bleaching. Another disadvantage of such aliphatic thiols is that they sometimes emit objectionable odors.

There is a need then for prebleaching compositions that are more stable to oxygen but also provide all of the other desired photographic properties in processed color reversal photographic materials.

SUMMARY OF THE INVENTION

The problems with known processing methods and compositions are overcome with a photographic processing composition comprising:

a) at least 0.0001 mol/l of a cyclic mercapto bleach accelerating agent, and b) at least 0.0001 mol/l of a water-soluble or water-dispersible 2,6-diarylaminotriazine or diaminostilbene dye stain reducing agent, the amounts of the dye stain reducing agent and bleach accelerating agent being determined according to the following equation:

$$[\text{bleach accelerating agent, mol/l}] \geqq 0.01-10[\text{dye stain reducing agent, mol/l}].$$

This processing composition can also include a formaldehyde precursor.

This invention also provides a concentrated photographic processing composition comprising:

a) at least 0.0002 mol/l of a cyclic mercapto bleach accelerating agent, and b) at least 0.0002 mol/l of a water-soluble or water-dispersible 2,6-diarylaminotriazine or diaminostilbene dye stain reducing agent, the amounts of the dye stain reducing agent and bleach accelerating agent being determined according to the equation noted above.

This concentrated processing composition can also include a formaldehyde precursor.

Further, this invention provides a photographic processing kit comprising:

I) one of the photographic processing compositions described above (with or without a formaldehyde precursor), and II) one or more of a photographic color developing composition, a photographic bleaching composition, a photographic bleach-fixing composition, a photographic fixing composition, a photographic reversal composition, a black-and-white developing composition, or a dye stabilizing and/or final rinse composition.

Still again, a method of the present invention provides a positive color photographic image comprising contacting an imagewise exposed and color developed, color reversal photographic silver halide material with the photographic processing composition described above.

The present invention provides the desired prebleaching and/or conditioning compositions, both in concentrated and working strength forms that have improved storage stability in the presence of oxygen. In other words, the compositions are less sensitive to aerial oxidation. These benefits were unexpectedly found by using a combination of certain spectral sensitizing dye stain reducing agents and cyclic mercapto compounds that act as silver bleach accelerating agents. This combination of compounds in the prebleaching and/or conditioning compositions also has been found to consistently facilitate the reduction of residual silver during bleaching below the desired level of 10.8 mg/m$^2$ compared to the use of each type of compound alone in the compositions. Thus, each type of compound alone provides insufficient bleach acceleration or "activation" compared to the combination of compounds. Moreover, the use of the cyclic mercapto compounds as bleach accelerating agents avoids the use of aliphatic thiols that may emit objectionable odors.

DETAILED DESCRIPTION OF THE INVENTION

The processing compositions of the present invention generally contain two essential components: a cyclic mercapto bleach accelerating agent and a water-soluble 2,6-diarylaminotriazine or diaminostilbene dye stain reducing agent. Other optional and preferred components, described below, can also be present.

The cyclic mercapto bleach accelerating agents are generally heterocyclic or carbocyclic compounds having one or more mercapto groups directly or indirectly attached to the cyclic ring. Such compounds can be represented by the following Structure III:

III

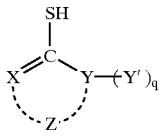

wherein X is a —CH— or a nitrogen atom, Y is a carbon, nitrogen, oxygen, or sulfur atom, Y' is hydrogen or any suitable substituent group, q is 0 or 1, and Z represents the carbon, nitrogen, and oxygen atoms necessary to complete a 5- to 7-membered, substituted or unsubstituted heterocyclic ring.

Preferably Y is nitrogen or sulfur, and more preferably, it is sulfur. The heterocyclic ring is preferably a 5- to 6-membered substituted or unsubstituted heterocyclic ring. Preferably, Y' is a hydrogen atom.

The heterocyclic ring represented by Structure III can have one or more substituents that are limited by the number of open valences. Such substituents must be chosen so that they do not adversely affect the performance of the bleach accelerating agent. Such substituents can include, but are not limited to, amino groups (primary, secondary, or tertiary), carboxy groups, substituted or unsubstituted alkyl groups having 1 to 8 carbon atoms (such as methyl, ethyl, 2-hydroxyethyl, 2,4-dihydroxybutyl, and benzyl), substituted or unsubstituted carbocyclic or heterocyclic aryl groups (such as phenyl, p-methoxyphenyl, and naphthyl).

Representative useful cyclic mercapto bleach accelerating agents include, but are not limited to, mercaptotriazole (MT), 5-amino-1,3,4-thiadiazole-2(3H)-thione (ATT), o-mercaptobenzoic acid (MBA), and tetrahydro-5-(2-hydroxyethyl)-1,3,5-triazine-2(1H)-thione (HTTT). ATT is most preferred.

Mixtures of these compounds can also be used if desired.

The dye stain reducing agents useful in the processing compositions of the present invention are selected from two classes of compounds.

One class of dye stain reducing compounds includes compounds that are known as triazinylstilbenes. In some publications, triazinylstilbenes are identified as "triazylstilbenes". Preferably, the useful triazinylstilbenes are water-soluble or water-dispersible from the presence of one or more solubilizing groups.

While not intending to be limiting in the definition of triazinylstilbenes useful in the practice of this invention, preferred compounds can be represented by the following Structure I:

I

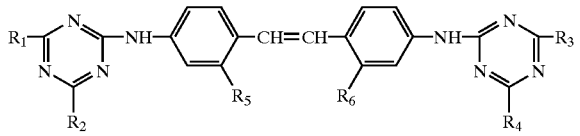

wherein $R_1$, $R_2$, $R_3$ and $R_4$ are independently hydroxy, halo (such as fluoro, chloro, bromo or iodo), a substituted or unsubstituted morpholino group, a substituted or unsubstituted aryl group generally having 6 to 10 carbon atoms in the carbocyclic ring (such as phenyl, a methoxyphenyl or a halophenyl), substituted or unsubstituted alkoxy group generally having a chain of from 1 to 10 carbon atoms that can be interrupted with one or more oxy, amino or carbonyl groups (such as methoxy, ethoxy, isopropoxy and t-butoxy), substituted or unsubstituted aryloxy group generally having from 6 to 10 carbon atoms in the carbocyclic ring (such as phenoxy or a chlorophenoxy), a substituted or unsubstituted alkyl group generally having from 1 to 10 carbon atoms (such as methyl, ethyl, isopropyl, t-butyl, n-hexyl, methoxymethyl, 2-chloroethyl and benzyl), an amino group (both cyclic and acyclic), an alkylamino group (both secondary and tertiary amines, each alkyl group as defined above) or an arylamino group (both secondary and tertiary, each aryl group as defined above. Preferably, $R_1$, $R_2$, $R_3$ and $R_4$ are independently an alkoxy group, an alkylamino group or an arylamino group, as defined above.

$R_5$ and $R_6$ are independently hydrogen or sulfo, provided at least one of $R_5$ and $R_6$ is sulfo. In preferred embodiments, each of these radicals is sulfo. The sulfo can be in free acid or salt form (sodium, potassium or ammonium salts).

Representative compounds within Structure I are described in U.S. Pat. No. 4,232,112 (Kuse), U.S. Pat. No. 4,587,195 (Ishikawa et al), and U.S. Pat. No. 5,043,253 (Ishakawa), all incorporated herein by reference with respect to such compounds. It is to be understood that at least some of these compounds can exist in various isomeric forms.

Single isomers or mixtures thereof can also been used in the practice of this invention. The most preferred triazinylstilbene compounds (and isomers thereof) include the following Compounds I-1 and I-2:

I-1

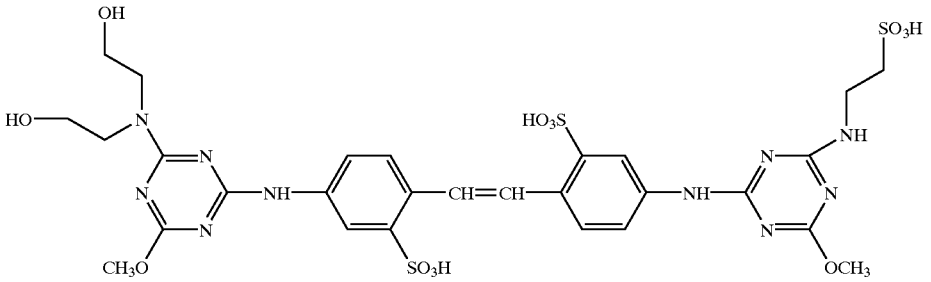

I-2

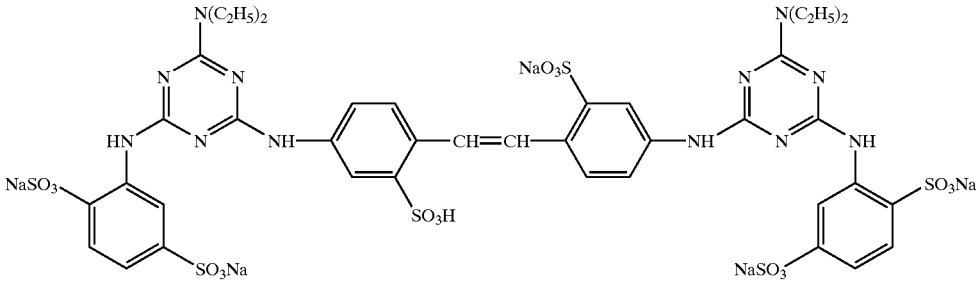

Compound I-1 is most preferred, and is commercially available as BLANKOPHOR REU from Bayer. Compound I-2 is commercially available as TINOPAL SFP from Ciba.

Alternative dye stain reducing compounds useful in the prebleaching compositions of this invention are water-soluble or water-dispersible 2,6-diarylaminotriazines. These compounds are colorless or slightly yellow in color, and have an extended planar π system. By this is meant they are compounds that have planar delocalized electron densities extending over more than ten non-hydrogen atoms. There can be a mixture of such compounds in the compositions of this invention, in any suitable proportions.

More particularly, the dye stain reducing agents useful in this invention are 2,6-diarylaminotriazines (including but not limited to 2,6-dinaphthylaminotriazines). It is especially desirable that these compounds have at least two solubilizing groups attached to one or both aryl groups in the molecule. Useful solubilizing groups include, but are not limited to, sulfo, carboxy, hydroxy, carbonamido, sulfonamido and other groups readily apparent to one skilled in the art. The sulfo and carboxy groups are preferred, and the sulfo groups are most preferred. The maximum number of solubilizing groups in a given molecule is limited only by the available number of substituent positions, but for practical purposes, there may be up to ten of the same or different solubilizing groups in the molecules.

In preferred embodiments of this invention, the processing compositions of this invention can comprise one or more dye stain reducing agents represented by the following Structure II:

II

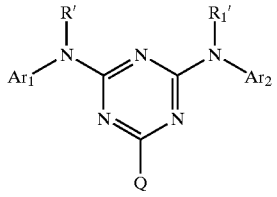

wherein $Ar_1$ and $Ar_2$ are independently carbocyclic or heterocyclic aromatic groups comprising at least 2 solubilizing groups on one or both aromatic groups. Useful aromatic groups generally have from 6 to 14 carbon atoms in the ring (for carbocyclic groups) or from 5 to 14 carbon, oxygen, sulfur and nitrogen atoms in the ring (for heterocyclic groups). Representative groups include, but are not limited to, substituted or unsubstituted phenyl groups, substituted or unsubstituted naphthyl groups, substituted or unsubstituted anthryl groups, substituted or unsubstituted pyridyl groups, substituted or unsubstituted benzimidazole groups, and substituted or unsubstituted benzothiazole groups. The substituted or unsubstituted carbocyclic aromatic groups are preferred and the substituted or unsubstituted naphthyl groups are more preferred. Besides the solubilizing groups described herein, either or both aromatic groups can be substituted with (that is, by replacement of a hydrogen atom) additional substituents that do not adversely affect their beneficial effects in the processing compositions.

Also in Structure I above, Q is hydrogen, hydroxy, thiol, sulfo, carboxy, a —$NR_2'R_3'$ group, a —$OR_2'$ group, or a halo group (such as fluoro, chloro, bromo or iodo). Preferably, Q is hydrogen, hydroxy, thiol, sulfo or a halo group (such as chloro or bromo), and more preferably, it is sulfo. As used throughout this application, "sulfo" and "carboxy" refer to the respective free acid moieties as well as their equivalent salts (such as ammonium ion and alkali metal salts).

R' and $R_1$' are independently hydrogen, substituted or unsubstituted alkyl groups having 1 to 3 carbon atoms (such as methyl, ethyl, n-propyl or isopropyl) or substituted or unsubstituted hydroxyalkyl groups having 1 to 3 carbon atoms (such as methoxy, 2-ethoxy, isopropoxy, methoxymethoxy). Preferably, R' and $R_1$' are independently hydrogen, methyl or hydroxymethyl, and preferably, each is hydrogen.

$R_2$' and $R_3$' are independently hydrogen, substituted or unsubstituted alkyl groups having 1 to 6 carbon atoms (such as methyl, hydroxymethyl, 2-hydroxyethyl, carboxymethyl, ethyl, isopropyl, n-propyl, 5-carboxy-n-pentyl and hexyl), or substituted or unsubstituted phenyl groups (such as xylyl, tolyl, 4-hydroxyphenyl, 4-carboxyphenyl and 3,5-disulfophenyl).

As indicated in the preceding paragraphs, any of Q, R', $R_1$', $R_2$' and $R_3$' can be substituted with one or more solubilizing groups that are defined above.

Representative compounds useful in the practice of this invention include, but are not limited to, the following Compounds II-1 through II-17:

II-1

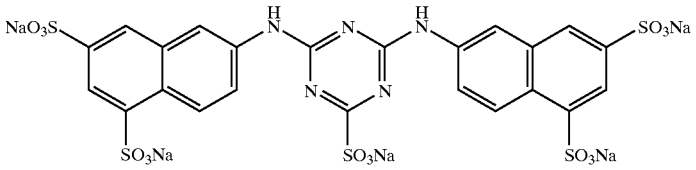

II-2

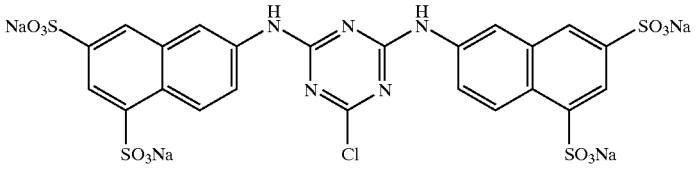

II-3

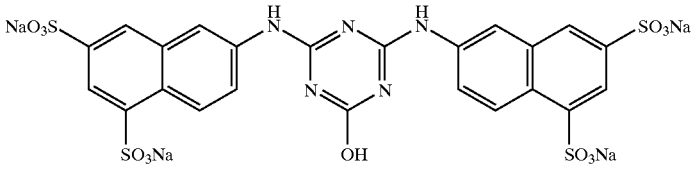

II-4

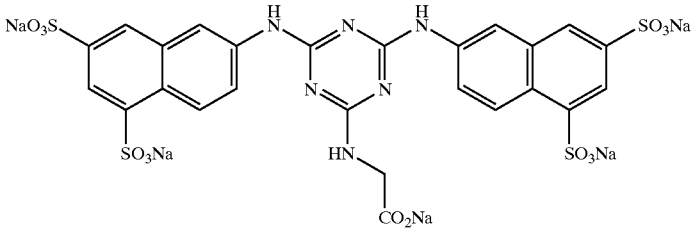

II-5

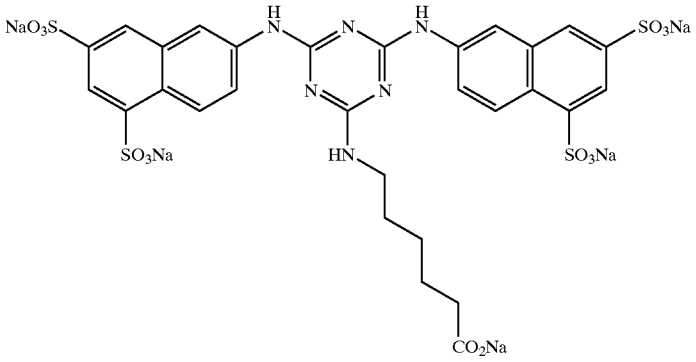

-continued
II-6
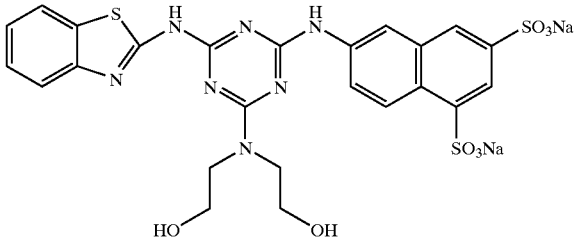
II-7
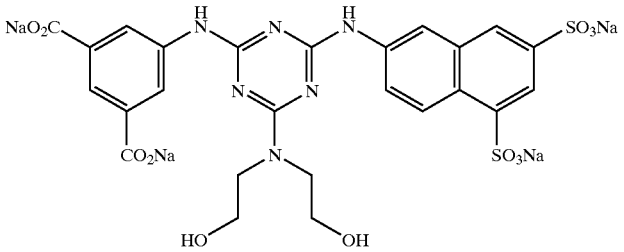
II-8
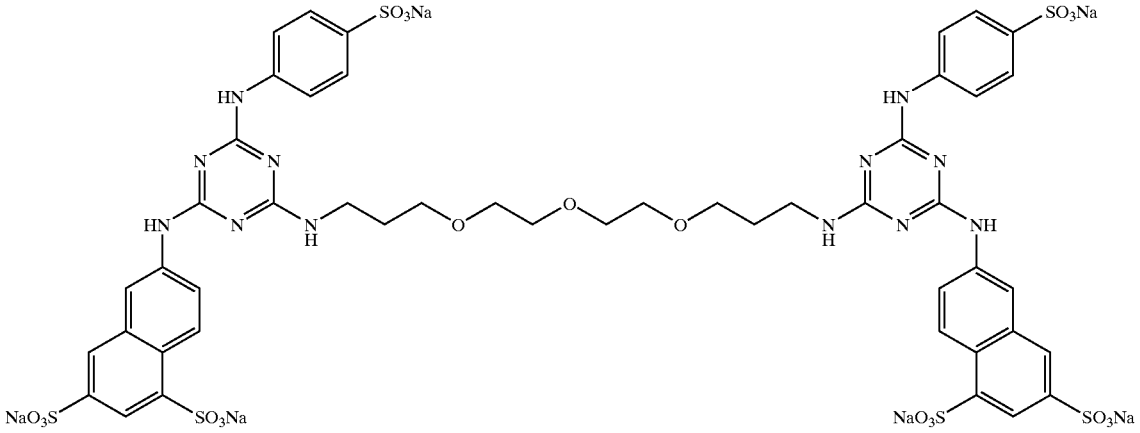
II-9
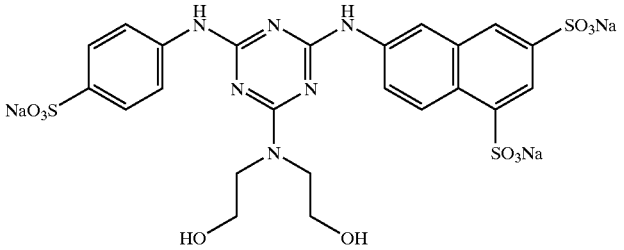
II-10
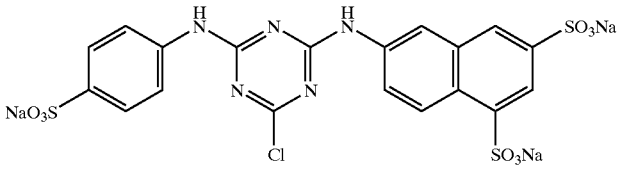

-continued
II-11
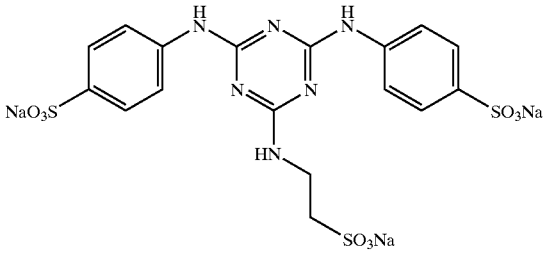
II-12
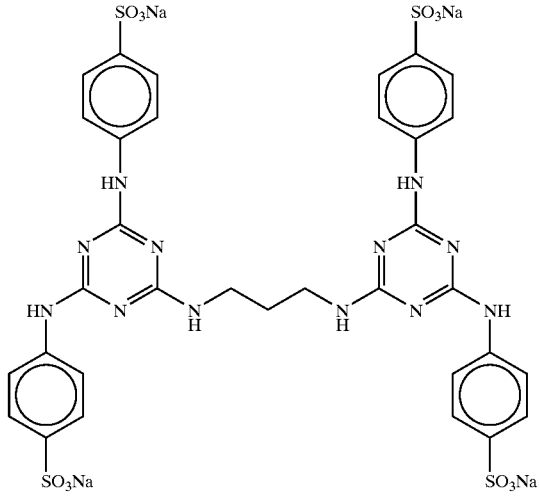
II-13
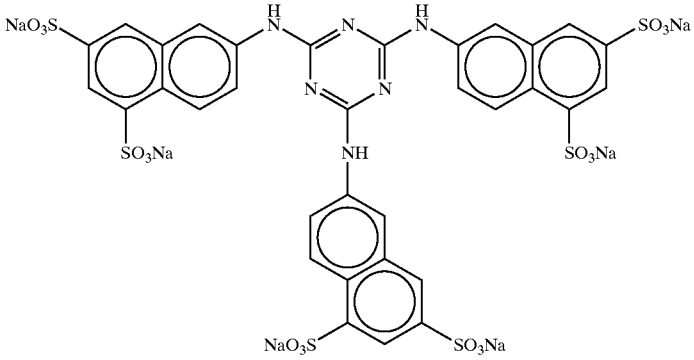
II-14
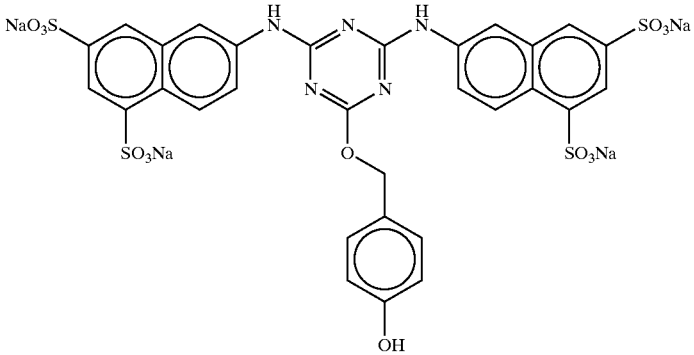
II-15
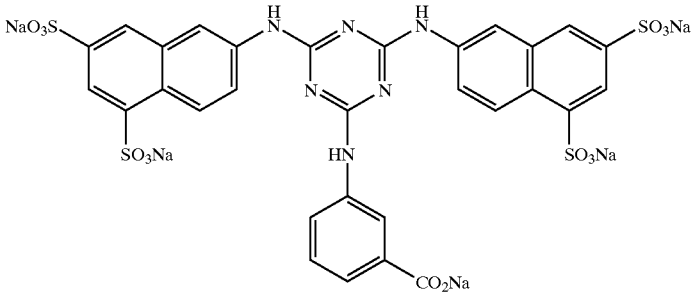

-continued

II-16

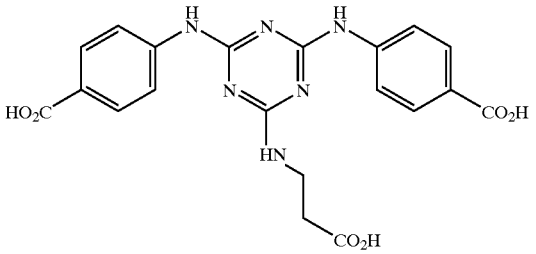

II-17

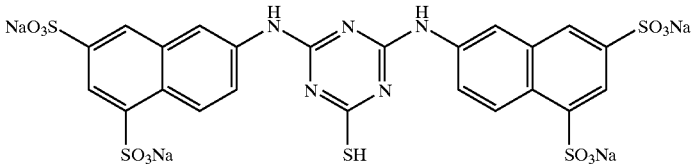

A subset of the useful compounds of Structure II can be represented by the following Structure IIa:

IIa

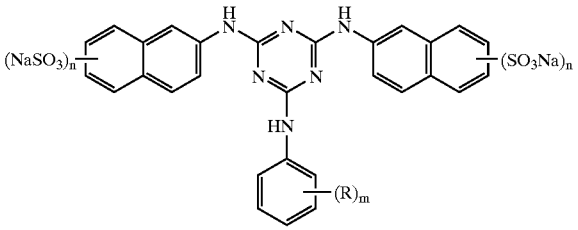

wherein R is carboxy (or salt thereof) or sulfo (or salt thereof), m is an integer of from 0 to 5, and n is an integer of from 2 to 7. Preferably, R is carboxy, m is an integer of 1 to 2, and n is 2.

Representative compounds within Structure IIa are the following Compounds IIa-1 to IIa-7:

IIa-1

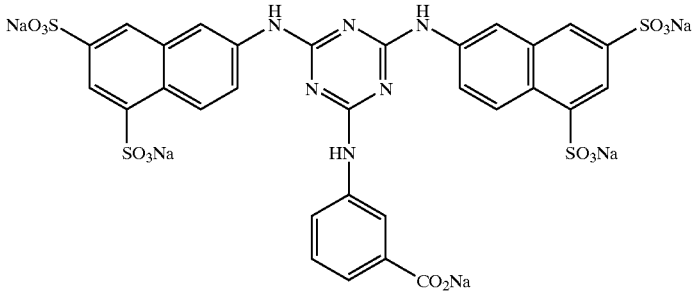

IIa-2

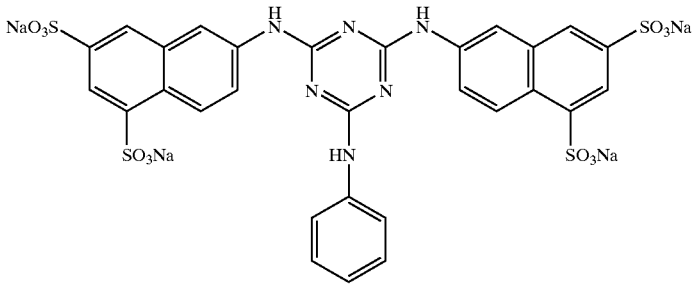

-continued
IIa-3
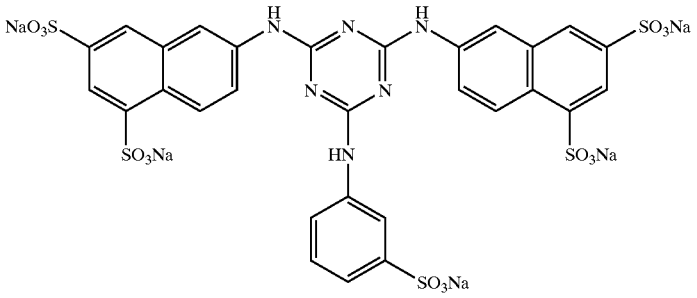
IIa-4
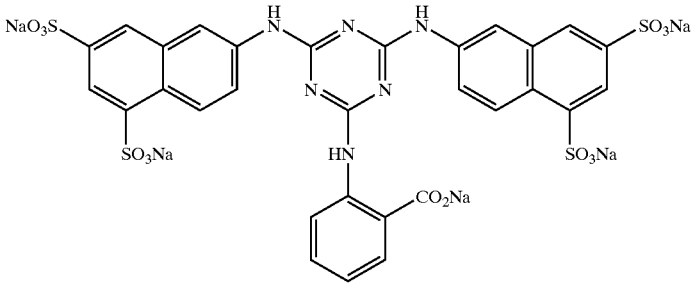
IIa-5
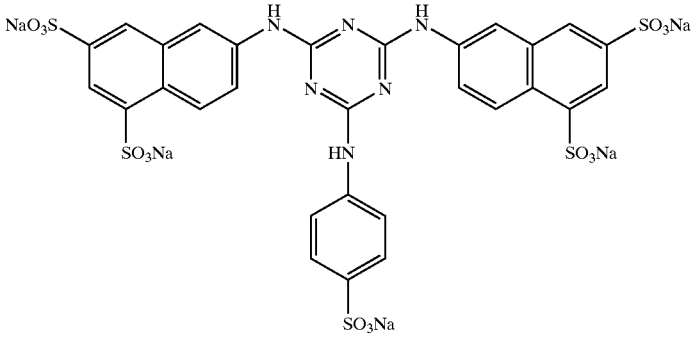
II-6
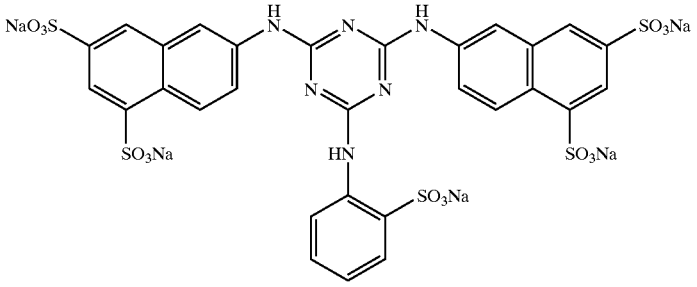
II-7
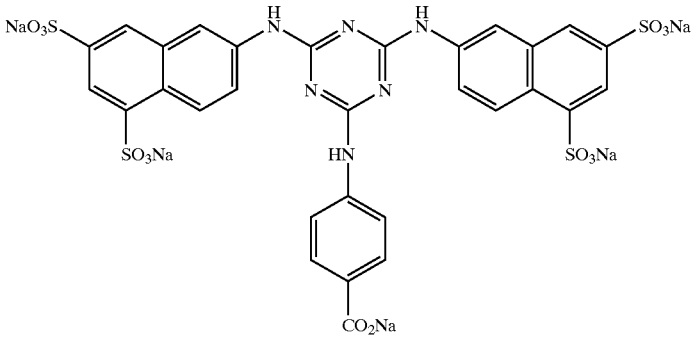

The processing compositions of this invention also include one or more formaldehyde precursors to provide dye image stability. By the term "formaldehyde precursor" is meant any compound capable of establishing, in the composition, an equilibrium relationship between it and formaldehyde. While not being certain of the mechanism, it is believed that the precursor acts, in effect, as a formaldehyde donor that gradually releases formaldehyde into the composition at the same rate as it is used up in a dye stabilization reaction to thereby maintain the equilibrium relationship. The concentration of formaldehyde in the processing composition is always at a sufficiently low level that there is not enough formaldehyde in the solution to result in a buildup or undesirably high concentration in the air above the composition.

Formaldehyde precursors that are useful for the purpose of this invention include but are not limited to the water-soluble N-methylol compounds. As used herein, the term "N-methylol compound" refers to a compound having at least one methylol group attached directly to a nitrogen atom. Particularly useful are N-methylol compounds represented by formulae I, II, or III in U.S. Pat. No. 4,921,779 (noted above).

Illustrative N-methylol compounds include, but are not limited to, dimethylol urea, trimethylol urea, dimethylol guanidine, trimethylol melamine, tetramethylol melamine, pentamethylol melamine, and hexamethylol melamine. Another particularly preferred N-methylol compound is 1,3-dimethylol-5,5-dimethyl hydantoin.

Examples of especially effective formaldehyde precursors include sodium formaldehyde bisulfite and hexamethylenetetraamine.

The formaldehyde precursor can be added to the compositions as a specifically added component, or it can be formed in situ by the reaction of formaldehyde and a bisulfite as one skilled in the art would readily understand.

The processing compositions of this invention (both concentrates and working strength solutions) are generally aqueous acidic solutions typically having a pH in the range of from about 4.5 to about 8. Preferably, the pH is from about 4.5 to about 6.5. The pH can be adjusted and maintained using one or more acids or buffers, as would be readily apparent to one skilled in the art.

An optional (but preferred) component of the compositions of this invention is a sulfite preservative (or a mixture thereof). It can be present in an amount of from 0 to about 2 mol/l of concentrate, and from 0 to about 0.4 mol/l in the working strength composition. Useful sulfites (and corresponding bisulfites) are well known in the art and include, for example, sodium sulfite, potassium sulfite, lithium sulfite, ammonium sulfite and corresponding bisulfites. Potassium and sodium sulfites are preferred.

Also optionally included in the composition is one or more metal ion chelating agents, such as chelating agents for iron, calcium, magnesium, manganese, copper and other metals commonly found in processing solutions. Preferably, chelating agents for iron ions (such as ferric ion) are used. Useful chelating agents are well known in the art such as polydentate carboxylic acids and phosphonic acids that are generally known for photographic bleaching solutions.

Another optional component of the prebleaching composition is a secondary amine compound such as those described in U.S. Pat. No. 5,523,195 (Darmon et al.), incorporated herein by reference. Of these compounds, diethanolamine, morpholine, and piperidine are preferred.

The prebleaching solution of this invention can also include various addenda commonly included in such solutions, as described in the art cited above, including, but not limited to, anti-scumming agents, surfactants, buffers, biogrowth control agents (for example, polyamincarboxylic acids such as ethylenediaminetetraacetic acid), and antioxidants.

The following TABLE I shows the general and preferred (in parentheses) ranges for the two essential and one preferred component of the processing compositions of this invention. These ranges are approximate so that the end points are considered "about" the noted amount.

TABLE I

| COMPONENT | WORKING STRENGTH COMPOSITION (mol/l) | CONCENTRATED COMPOSITION (mol/l) |
|---|---|---|
| Cyclic mercapto bleach accelerating agent | 0.0001–0.05 (0.005–0.015) | 0.0002–0.25 (0.025–0.075) |
| Formaldehyde precursor | 0.05–1 (0.1–0.4) | 0.25–5 (0.5–2) |
| Dye stain reducing agent | 0.0001–0.01 (0.0005–0.003) | 0.0002–0.05 (0.0025–0.015) |

In addition, the benefits of the present invention are achieved by having the cyclic mercapto bleach accelerating agent and the dye stain reducing agent that are present in a particular relationship defined by the following equation in which the concentrations are in mol/l:

$$\text{bleach accelerating agent} \geqq 0.01-10(\text{dye stain reducing agent}).$$

The prebleaching and conditioning compositions of the present invention are useful for providing a color image in imagewise exposed photographic color reversal silver halide materials such as color reversal films and papers. Such films and papers are well known in the art, having been described in various publications and have been commercialized as different products from several manufacturing companies such as Eastman Kodak Company, Konica Photo Co., Fuji Photo Co, and AGFA.

Generally, in the processing of color photographic materials to provide positive color images, the materials are imagewise exposed in a suitable fashion using a suitable imaging source (tungsten lamps, sunlight, lasers and phosphors). The imagewise exposed materials are then processed in a series of wet photographic processing baths in a suitable sequence of steps to initiate various chemical reactions in the silver halide and color-forming materials to generate the desired images.

To obtain positive color images in color reversal photographic films, the typical sequence of steps includes first development (black-and-white development), a reversal (or universal fogging) step, color developing, prebleaching or conditioning, bleaching, fixing, and stabilizing and/or rinsing. There may be various water washing steps between other steps. Alternatively, dye stabilizing can occur in the prebleaching or conditioning step between color developing and bleaching. Many details of such processes are provided in U.S. Pat. No. 5,552,264 (noted above), incorporated herein by reference. Other details are provided in *Research Disclosure,* publication 38957 (noted above), and references noted therein.

As used herein, "photographic processing composition" refers to a composition in liquid, solid or multi-phase form that is used in one or more photographic processing steps and that contains one or more "photochemicals" that participate, facilitate or otherwise foster a photochemical reaction or physical benefit in the photographic processing step. In most instances, the photochemicals are involved in some type of chemical reaction within the processed photographic material, or in the processing composition itself. Examples of such photochemicals include, but are not limited to, black-and-white developing agents, co-developing agents, color developing agents, bleaching agents, fixing agents, dye stabilizing agents, fixing accelerators, bleaching accelerators, formaldehyde precursors, antifoggants, fogging agents and development accelerators. In other instances, the photochemicals may provide a physical benefit such as reduced scumming, reduced crystal growth on processing equipment, reduced sludge, reduced film residue or spotting, storage stability and reduced biogrowth. Examples of such photochemicals include, but are not limited to, surfactants, antioxidants, crystal growth inhibitors and biocides.

The first (black-and-white) developing step is usually carried out using a conventional black-and-white developing solution that can contain black-and-white developing agents, auxiliary co-developing agents, preservatives, antifoggants, anti-sludging agents, buffers and other conventional addenda. Useful first developing compositions are described for example, in U.S. Pat. No. 5,298,369 (Munshi et al.) and U.S. Pat. No. 5,552,264 (noted above).

After the first development step, the processed color reversal materials are subjected to a reversal composition such as those described, for example, in U.S. Pat. No. 3,617,282 (Bard et al), U.S. Pat. No. 5,736,302 (Buongiorne et al), U.S. Pat. No. 5,811,225 (McGuckin et al), U.S. Pat. No. 6,033,833 (Tsoi et al.), U.S. Pat. No. 6,074,805 (Badger et al.), all incorporated herein by reference. Alternatively, the materials can be subjected to universal fogging using known techniques to render all previously unexposed silver halide developable to silver metal.

Photographic color developing compositions useful in the practice of this invention typically include one or more color developing agents and various other conventional addenda including preservatives or antioxidants (including sulfites, and hydroxylamine and its derivatives), sulfites, metal ion sequestering agents, corrosion inhibitors and buffers. These materials can be present in conventional amounts. For example, the color developing agent is generally present in an amount of at least 0.001 mol/l (preferably at least 0.01 mol/l), and an antioxidant or preservative for the color developing agent is generally present in an amount of at least 0.0001 mol/l (preferably at least 0.001 mol/l). The pH of the composition is generally from about 9 to about 13, and preferably from about 11.5 to about 12.5.

Exemplary color developing compositions and components (except the sensitizing dye stain reducing agents described herein) are described for example, in EP-A-0 530 921 (Buongiorne et al.), U.S. Pat. No. 5,037,725 (Cullinan et al.), U.S. Pat. No. 5,552,264 (Cullinan et al.), U.S. Pat. No. 5,508,155 (Marrese et al.), U.S. Pat. No. 4,892,804 (Vincent et al.), U.S. Pat. No. 4,482,626 (Twist et al.), U.S. Pat. No. 4,414,307 (Kapecki et al.), U.S. Pat. No. 4,876,174 (Ishikawa et al.), U.S. Pat. No. 5,354,646 (Kobayashi et al.), U.S. Pat. No. 4,264,716 (Vincent et al.), and U.S. Pat. No. 6,037,111 (Haye et al.), the disclosures of which are all incorporated herein for their teaching about color developing compositions.

Useful preservatives in the color developing compositions include sulfites (such as sodium sulfite, potassium sulfite, sodium bisulfite and potassium metabisulfite), hydroxylamines and its derivatives, especially those derivatives having substituted or unsubstituted alkyl or aryl groups, hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. More particularly useful hydroxylamine derivatives include substituted and unsubstituted monoalkyl- and dialkylhydroxylamines (especially those substituted with sulfo, carboxy, phospho, hydroxy, carbonamido, sulfonamido or other solubilizing groups). Mixtures of compounds from the same or different classes of antioxidants can also be used if desired.

Examples of useful antioxidants are described for example, in U.S. Pat. No. 4,892,804 (noted above), U.S. Pat. No. 4,876,174 (noted above), U.S. Pat. No. 5,354,646 (noted above), U.S. Pat. No. 5,660,974 (Marrese et al.), U.S. Pat. No. 5,646,327 (Burns et al.), and U.S. Pat. No. 6,077,653 (McGarry), the disclosures of which are all incorporated herein by reference for description of useful antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

Most preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.), incorporated herein by reference.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

Particularly useful color developing agents include aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD4), p-hydroxyethylethylaninoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. A most preferred color developing agent is KODAK Color Developing Agent CD-3 for the processing of color reversal materials.

Single-phase, single-part color developing compositions may be useful as described in U.S. Pat. No. 6,077,651 (Darmon et al.). Useful, multi-part color developing compositions are described in U.S. Pat. No. 6,136,518 (Buongiorne et al.).

Photographic bleaching compositions useful in the practice of this invention generally include one or more persulfate, peracid (such as hydrogen peroxide, periodates or percarbonates) or high metal valent ion bleaching agents, such as iron (III) complexes with simple anions (such as nitrate, sulfate, and acetate), or with carboxylic acid or phosphonic acid ligands. Particularly useful bleaching agents include iron complexes of one or more aminocarboxylic acids, aminopolycarboxylic acids, polyaminocarboxylic acids or polyaminopolycarboxylic acids, or salts thereof. Particularly useful chelating ligands include conventional polyaminopolycarboxylic acids including ethylenediaminetetraacetic acid and others described in *Research Disclosure,* noted above, U.S. Pat. No. 5,582,958 (Buchanan et al.), and U.S. Pat. No. 5,753,423 (Buongiome et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al.), all of which are incorporated herein by reference in relation to their description of bleaching agents.

These and many other such complexing ligands known in the art including those described in U.S. Pat. No. 4,839,262 (Schwartz), U.S. Pat. No. 4,921,779 (Cullinan et al.), U.S. Pat. No. 5,037,725 (noted above), U.S. Pat. No. 5,061,608 (Foster et al.), U.S. Pat. No. 5,334,491 (Foster et al.), U.S. Pat. No. 5,523,195 (Darmon et al.), U.S. Pat. No. 5,582,958 (Buchanan et al.), U.S. Pat. No. 5,552,264 (noted above), U.S. Pat. No. 5,652,087 (Craver et al.), U.S. Pat. No. 5,928,844 (Feeney et al.), U.S. Pat. No. 5,652,085 (Wilson et al.), U.S. Pat. No. 5,693,456 (Foster et al.), U.S. Pat. No. 5,834,170 (Craver et al.), and U.S. Pat. No. 5,585,226 (Strickland et al.), all incorporated herein by reference for their teaching of bleaching compositions. The total amount of bleaching agent(s) in the composition is generally at least 0.0001 mol/l, and preferably at least 0.05 mol/l. These amounts are also useful for bleach-fixing compositions described below.

Bleaching compositions can be stabilized by using an organic amine base with certain ferric bleaching agents, as described in U.S. Pat. No. 6,077,650 (Price). Cyan dye density can be maximized using the bleaching compositions of U.S. Pat. No. 6,096,487 (Foster). High halide bleaching compositions are described in copending U.S. Ser. No. 09/614,798 (filed Jul. 12, 2000 by Price).

Other components of the bleaching composition include buffers, halides, corrosion inhibiting agents, and metal ion sequestering agents. These and other components and conventional amounts are described in the references in the preceding paragraph. The pH of the bleaching composition is generally from about 4 to about 6.5.

Particularly useful bleaching agents are ferric ion complexes of one or more of ethylenediaminetetraacetic acid (EDTA), ethylenediaminedisuccinic acid (EDDS, particularly the S,S-isomer), methyliminodiacetic acid (MIDA) or other iminodiacetic acids, β-alaninediacetic acid (ADA), ethylenediaminemonosuccinic acid (EDMS), 1,3-propylenediaminetetraacetic acid (PDTA), nitrilotriacetic acid (NTA), and 2,6-pyridinedicarboxylic acid (PDCA). The most preferred bleaching agent is a ferric ion complex of EDTA for processing color reversal materials. For processing color negative materials and color papers, a ferric complex of PDTA is preferred. Multiple bleaching agents can be present if desired.

Photographic fixing compositions generally include one or more fixing agents. Useful fixing agents for photographic fixing compositions are well known. Examples of photographic fixing agents include, but are not limited to, thiosulfates (for example sodium thiosulfate, potassium thiosulfate and ammonium thiosulfate), thiocyanates (for example sodium thiocyanate, potassium thiocyanate and ammonium thiocyanate), thioethers (such as ethylenebisthioglycolic acid and 3,6-dithia-1,8-octanediol), imides and thiourea. Thiosulfates and thiocyanates are preferred, and thiosulfates are more preferred. Ammonium thiosulfate is most preferred. The general amount of total fixing agents in the fixing composition is at least 0.001 mol/l, and preferably at least 0.1 mol/l. These amounts are also useful for the bleach-fixing compositions described below.

It is also known to use fixing accelerators in fixing compositions. Representative fixing accelerators include, but are not limited to, ammonium salts, guanidine, ethylenediamine and other amines, quaternary ammonium salts and other amine salts, thiourea, thioethers, thiols and thiolates. Examples of useful thioether fixing accelerators are described in U.S. Pat. No. 5,633,124 (Schmittou et al.), incorporated herein for the teaching of fixing compositions.

The fixing compositions generally contain one or more monovalent or divalent cations supplied by various salts used for various purposes (for example, salts of fixing agents). It is preferred that the cations be predominantly ammonium cations, that is at least 50% of the total cations are ammonium ions. The fixing compositions can also include one or more of various addenda optionally but commonly used in such compositions for various purposes, including hardening agents, preservatives (such as sulfites or bisulfites), metal sequestering agents (such as polycarboxylic acids and organophosphonic acids), buffers, and fixing accelerators. The amounts of such addenda in the working strength compositions would be readily known to one skilled in the art. It is also known from U.S. Pat. No. 6,013,423 (Price) to include uncomplexed aminodisuccinic acids in the fixing composition to reduce retained iron and yellow stain.

The desired pH of the fixing compositions is 8 or less, and can be achieved and maintained using any useful combination of acids and bases, as well as various buffers.

Concentrated and working strength fixing compositions can also include triazinylstilbenes to reduce residual spectral sensitizing dye stain, as described for example in U.S. Pat. No. 6,013,425 (Craver et al). Such useful triazinylstilbenes includes those illustrated by Structures I noted above. Other useful dye stain reducing agents that can be used in the fixing compositions are the 2,6-diarylaminotriazines represented by Structures II and IIa note above, as described in U.S. Pat. No. 6,153,365 (Goswami et al.).

Other details of fixing compositions not explicitly described herein are considered well known in the art, and are described for example, in *Research Disclosure* publication 38957 (noted below), and publications noted therein in paragraph XX(B), U.S. Pat. No. 5,424,176 (Schmittou et al.), U.S. Pat. No. 4,839,262 (noted above), U.S. Pat. No. 4,921,779 (noted above), U.S. Pat. No. 5,037,725 (noted above), U.S. Pat. No. 5,523,195 (noted above), U.S. Pat. No. 5,552,264 (noted above) U.S. Pat. No. 6,013,424 (Schmittou et al.), U.S. Pat. No. 6,022,676 (Schmittou et al.), U.S. Pat. No. 6,087,077 (Schmittou et al.), and U.S. Pat. No. 6,159,669 (Schmittou et al.), all of which are incorporated herein by reference for their teaching of fixing compositions.

During fixing, the fixing composition in the processor may accumulate dissolved silver halide, and other substances that are extracted from the processed photographic element. Such materials, and particularly silver halide, can be removed using known means, such as ion exchange, electroysis, electrodialysis and precipitation.

It is also possible to combine the bleaching and fixing functions in a single composition known as a bleach-fixing composition. Such compositions would include one or more bleaching agents, one or more fixing agents, and various other components as known in the art.

Another useful photographic processing composition is a dye stabilizing composition containing one or more photographic imaging dye stabilizing compounds. Such compositions can be used at the end of the processing sequence, and generally have a pH of from about 5.5 to about 8, and include a dye stabilization compound (such as an alkali metal formaldehyde bisulfite, hexamethylenetetramine, various benzaldehyde compounds, and various other formaldehyde releasing compounds), buffering agents, bleach-accelerating compounds, secondary amines, preservatives, and metal sequestering agents. All of these compounds and useful amounts are well known in the art, including U.S. Pat. No. 4,839,262 (Schwartz), U.S. Pat. No. 4,921,779 (noted above), U.S. Pat. No. 5,037,725 (noted above), U.S. Pat. No. 5,523,195 (noted above), and U.S. Pat. No. 5,552,264 (noted above), all incorporated herein by reference for their teaching of dye stabilizing compositions. Generally, one or more photographic dye stabilizing compounds are present in an amount of at least 0.0001 mol/l.

In some processing embodiments of this invention, a dye stabilizing composition or final rinsing composition of this invention is used to clean the processed photographic material as well as to stabilize the color image. Either type of composition generally includes one or more anionic, nonionic, cationic or amphoteric surfactants, and in the case of dye stabilizing compositions, one or more dye stabilizing compounds as described above. Particularly useful dye stabilizing compounds useful in these dye stabilizing compositions are described for example in EP-A-0 530 832 (Koma et al.) and U.S. Pat. No. 5,968,716 (McGuckin et al.). Other components and their amounts for both dye stabilizing and final rinsing compositions are described in U.S. Pat. No. 5,952,158 (McGuckin et al.), U.S. Pat. No. 3,545,970 (Giorgianni et al.), U.S. Pat. No. 3,676,136 (Mowrey), U.S. Pat. No. 4,786,583 (Schwartz), U.S. Pat. No. 5,529,890 (McGuckin et al.), U.S. Pat. No. 5,578,432 (McGuckin et al.), U.S. Pat. No. 5,534,396 (noted above), U.S. Pat. No. 5,645,980 (McGuckin et al.), U.S. Pat. No. 5,667,948 (McGuckin et al.), U.S. Pat. No. 5,750,322 (McGuckin et al.), U.S. Pat. No. 5,716,765 (McGuckin et al.), U.S. Pat. No. 6,022,764 (McGuckin et al.), U.S. Pat. No. 6,040,123 (Maudhuit et al.), all of which are incorporated by reference for their teaching of such compositions.

As noted above, the processing compositions of the present invention are used to process color positive photographic elements. The general sequence of steps and conditions (times and temperatures) for processing described herein include the known commercial Process E-6 and Process K-14.

The processing times and conditions for each of the processing steps described herein can be those commonly employed in Process E-6 and Process K-14, or any desirable variation thereof. The overall processing method times can be as short as 14 minutes and as high as 45 minutes, and the various steps are carried out at a temperature within the range of from about 25 to about 45° C. The details of these conditions are well known in the art and are illustrated in the Examples below.

Color reversal films preferably processed with the prebleaching or conditioning compositions of this invention are comprised of a support having thereon a plurality of photosensitive silver halide emulsion layers that can contain any conventional silver halide (or mixture thereof). Such films generally have silver halide emulsions having at least 1 mol % iodide based on total silver. Some specific commercially available color reversal photographic films that can be processed using this invention include EKTACHROME Color Reversal Films (Eastman Kodak Company), FUJICHROME Color Reversal Films (Fuji Photo Film Co., Ltd.), AGFACHROME Color Reversal Films (AGFA) and KONICACHROME Color Reversal Films (Konica).

The various processing steps can be carried out using single working strength composition baths (single stage) or multistage systems having multiple baths of the same processing composition. Agitation or recirculation can also be used in one or more steps if desired. Processing can also be carried out using any known method for contacting the processing prebleaching or conditioning composition of this invention and the photographic element. Such methods include, but are not limited to, immersing the photographic element in the working strength composition, laminating a cover sheet containing the composition to the photographic element, and applying the composition by high velocity jet or spraying.

Any of the processing compositions of this invention can be replenished at any suitable replenishment rate, for example, from about 500 to about 1500 ml/m$^2$.

The processing compositions of this invention can be provided in concentrated form and can be used directly, in diluted form, or used to prepare a replenishing solution. Concentrated compositions and methods of making are described for example in U.S. Pat. No. 5,948,604 (Craver et al.), incorporated herein by reference. Such concentrates can be diluted up to 10 times prior to or during use in the practice of this invention.

Processing can be carried out using any suitable processing equipment, including deep tank processors, and "low volume thin tank" processes including rack and tank and automatic tray designs, as described for example in U.S. Pat. No. 5,436,118 (Carli et al.), and publications noted therein. Thus, processing can be carried out in large-scale processing labs, or in what are known as "mini-labs" that are normally placed in smaller environments. Rotary tube processors can also be used for processing photographic materials.

The prebleaching or conditioning composition can be provided as one component of a processing kit that includes one or more other processing compositions necessary for providing positive color images (for example, black-and-white developing compositions, reversal compositions, color developing compositions, bleaching compositions, fixing compositions, bleach-fixing compositions, and stabilizing and/or rinsing compositions), as well as optional chemical components, metering devices, instructions and other addenda common to processing kits. These kits can be provided in a single package of suitable design with each processing composition in a suitable container in the form of glass or plastic bottles, vials, syringes, packettes, barrels, partially or wholly collapsible containers (as described for example in U.S. Pat. No. 5,577,614 of Palmeroni, Jr. et al.). While it is preferable that all of the compositions be in aqueous form, some or all of them can be in solid form as tablets, pellets, powders, or granules. One way of packaging processing compositions into a processing kit is described in U.S. Pat. No. 5,948,604 (noted above).

The following examples are provided to illustrate the invention, and not to be limiting in any fashion.

Comparative Example 1

Working strength prebleaching compositions were prepared having the following components and concentrations:

| Component | g/liter | mol/liter |
|---|---|---|
| Formaldehyde (37%) | 36.3 | 0.44 |
| Sodium metabisulfite | 42.7 | 0.23 |
| Potassium sulfite (45%) | 29.1 | 0.41 |
| Ethylenediaminetetraacetic acid (EDTA) | 5.00 | 0.017 |
| Phosphoric acid (75%) | 1.18 | 0.008 |

After adding each compound to be tested as a bleach accelerating agent to the just described formulation, each working strength prebleaching composition was then used to process samples of KODAK EKTACHROME Elite II 100 Color Reversal Film using the following standard Process E-6 processing protocol, times and temperatures:

| | |
|---|---|
| First Development (6 minutes) | KODAK First Developer, Process E-6 |
| Water Washing (2 minutes) | |
| Reversal bath (2 minutes) | KODAK Reversal Bath, Process E-6 |
| Color Development (6 minutes) | KODAK Color Developer, Process E-6 |
| Prebleaching (2 minutes) | Compositions described herein |
| Bleaching (6 minutes) | KODAK Bleach, Process E-6 |
| Fixing (4 minutes) | KODAK Fixer, Process E-6 |
| Water Washing (4 minutes) | |
| Final Rinsing (2 minutes) | KODAK Final Rinse, Process E-6 |
| Drying (20 minutes) | |

The amount of residual silver in the processed film samples was determined by inductively coupled plasma atomic emission spectroscopy after digesting the samples with a mixture of sulfuric and nitric acids.

Triazine dye stain reducing agent Compound II-15 was tested as a bleach accelerating agent at various concentrations. It is known to be a good dye stain reducing agent, but we wanted to see if it could perform the bleach accelerating function as well. TABLE II below lists the experiments, the amounts of Compound II-15, and the residual silver results.

TABLE II

| Experiment | II-15 Concentration (mol/l) | Residual silver (mg/m$^2$) |
|---|---|---|
| C-1-1 | 0 | 82.4 |
| C-1-2 | $2.15 \times 10^{-4}$ | 58.6 |
| C-1-3 | $4.30 \times 10^{-4}$ | 46.3 |
| C-1-4 | $1.08 \times 10^{-3}$ | 30.5 |
| C-1-5 | $2.15 \times 10^{-3}$ | 19.4 |
| C-1-6 | $3.24 \times 10^{-3}$ | 15.4 |

In order to avoid any visible effect on the resulting color image, the amount of retained silver in a color reversal film should be below 10.8 mg/m$^2$. The results in TABLE II indicate that the addition of Compound II-15 to the prebleaching composition did not acceptably reduce the amount of residual silver in the processed film samples even at relatively high concentrations.

Comparative Example 2

The working strength prebleaching formulation described in Comparative Example 1 was further used to test the use of bleach accelerator agent "ATT" (identified above) to reduce residual silver. Samples of the same color reversal film were imagewise exposed and similarly processed as described in Comparative Example 1. TABLE III below shows the amount of ATT used in each working strength prebleaching composition and the residual silver results.

TABLE III

| Experiment | "ATT" Concentration (mol/l) | Residual silver (mg/m$^2$) |
|---|---|---|
| C-2-1 | 0 | 82.4 |
| C-2-2 | $5 \times 10^{-3}$ | 29.8 |
| C-2-3 | $1.0 \times 10^{-2}$ | 23.8 |
| C-2-4 | $1.5 \times 10^{-2}$ | 19.1 |

The results in TABLE III indicate that the use of ATT in the prebleaching composition reduces the amount of residual silver, but not to the desired level of less than 10.8 mg/m$^2$.

EXAMPLE 1

Various working strength prebleaching compositions of this invention were prepared using the same formulation described in Comparative Example 1 but with the addition of various amounts of Compound II-15 (triazine dye stain reducing agent) and "ATT" (bleach accelerating agent). Samples of the same color reversal film were imagewise exposed and similarly processed as described in Comparative Example 1. The various compositions, the amounts of Compound II-15 and ATT, residual silver values are shown in the following TABLE IV.

TABLE IV

| Experiment | II-15 Concentration (mol/l) | "ATT" Concentration (mol/l) | Residual silver (mg/m$^2$) |
|---|---|---|---|
| 1-1 | $2.15 \times 10^{-3}$ | $5.0 \times 10^{-3}$ | 3.01 |
| 1-2 | $2.15 \times 10^{-3}$ | $1.5 \times 10^{-2}$ | 2.27 |
| 1-3 | $1.08 \times 10^{-3}$ | $1.05 \times 10^{-3}$ | 10.0 |
| 1-4 | $1.08 \times 10^{-3}$ | $1.5 \times 10^{-2}$ | 5.51 |
| 1-5 | $3.23 \times 10^{-3}$ | $1.05 \times 10^{-3}$ | 14.0 |
| 1-6 | $3.23 \times 10^{-3}$ | $1.5 \times 10^{-2}$ | 5.97 |
| 1-7 | $2.15 \times 10^{-3}$ | $3.98 \times 10^{-3}$ | 2.69 |
| 1-8 | $1.0 \times 10^{-3}$ | $1.0 \times 10^{-3}$ | 13.9 |
| 1-9 | $1.0 \times 10^{-3}$ | $5.0 \times 10^{-3}$ | 6.49 |
| 1-10 | $1.0 \times 10^{-3}$ | $1.0 \times 10^{-2}$ | 5.80 |
| 1-11 | $4.0 \times 10^{-4}$ | $1.0 \times 10^{-3}$ | 21.2 |
| 1-12 | $4.0 \times 10^{-4}$ | $5.0 \times 10^{-3}$ | 13.4 |
| 1-13 | $4.0 \times 10^{-4}$ | $1.0 \times 10^{-2}$ | 8.46 |

The data in TABLE IV indicate that in order to reduce the residual silver to below 10.8 mg/m$^2$, the dye stain reducing agent, such as Compound II-15, should be present in the working strength composition at a concentration of at least $1.0 \times 10^{-4}$ mol/l. Moreover, it is essential that the cyclic mercapto bleach accelerating agent, such as compound ATT, be present also in the working strength composition at a concentration expressed by the equation (amounts in mol/l), but not less than 1.0×10−4 mol/l:

$$\text{Bleach accelerating agent} \geqq 0.01-10(\text{dye stain reducing agent}).$$

The optimal concentrations of each chosen set of dye stain reducing agent and bleach accelerating agent can be readily determined by one skilled in the art using a similar set of experiments.

EXAMPLE 2

Various sulfur-containing compounds were tested as bleach accelerating agents in combination with the preferred dye stain reducing agent, Compound II-15. A series of working strength prebleaching compositions were prepared using the formulation described in Comparative Example 1. To that formulation was added Compound II-15 at 2.15×

$10^{-3}$ mol/l and the various sulfur-containing compounds, each at $5.0\times10^{-3}$ mol/l.

Samples of the same color reversal film were imagewise exposed and similarly processed as described in Comparative Example 1. TABLE V below shows the various compounds tested and the residual silver data.

TABLE V

| Experiment | Compound Tested as Bleach Accelerating Agent | Residual silver (mg/m$^2$) |
|---|---|---|
| 2-1 | Mercaptotriazole | 3.54 |
| 2-2 | 5-Amino-1,3,4-thiadiazole-2(3H)-thione | 3.01 |
| 2-3 | Tetrahydro-5-(2-hydroxyethyl)-1,3,5-triazine-2(1H)-thione | 5.15 |
| 2-4 | o-Mercaptobenzoic acid | 6.40 |
| 2-5 | Dithiaoctanediol | 16.3 |
| 2-6 | Thiourea | 14.6 |
| 2-7 | 4-Carboxymethyl-4-thiazoline-2-thione | 9.79 |
| 2-8 | 4-Thiazoline-2-thione,4-(D,L-arabino-1,2,3,4-tetrahydroxybutyl)-(8CI) (DIS) | 5.13 |
| 2-9 | Sodium thiosulfate | 27.5 |

These results indicate that only the prebleaching compositions of this invention (Experiments 2-1, 2-2, 2-3, 2-4, 2-7, and 2-8) containing a cyclic mercapto bleach accelerating agent provided the desired low residual silver (less than 10.8 mg/m$^2$).

EXAMPLE 3

Various known dye stain reducing agents were tested in combination with the preferred bleach accelerating agent, "ATT". A series of working strength prebleaching compositions were prepared using the formulation described in Comparative Example 1. To that formulation was added compound ATT at $1.5\times10^{-2}$ mol/l and the dye stain reducing agents (Compounds II-15, I-1, I-2, and II-1), each at 2 g/l (various molar amounts).

Samples of the same color reversal film were imagewise exposed and similarly processed as described in Comparative Example 1. TABLE VI below shows the various compounds tested and the residual silver data.

TABLE VI

| Experiment | Dye Stain Reducing Agent (mol/l) | Residual silver (mg/m$^2$) |
|---|---|---|
| 3-1 | 0 | 19.1 |
| 3-2 | II-15, $2.15\times10^{-3}$ | 2.27 |
| 3-3 | I-1, $2.46\times10^{-3}$ | 6.60 |
| 3-4 | I-2, $1.53\times10^{-3}$ | 2.11 |
| 3-5 | II-1, $2.29\times10^{-3}$ | 4.05 |

These results indicate that all of the noted dye stain reducing agents are useful in the working strength prebleaching compositions of this invention, providing the desired low residual silver (less than 10.8 mg/m$^2$).

EXAMPLE 4

A preferred working strength prebleaching composition of this invention was used to process samples of several conventional color reversal films. These film samples were imagewise exposed and processed using the standard Process E-6 processing solutions and conditions but substituting a working strength prebleaching composition as described in Comparative Example 1 to which had been added dye stain reducing agent Compound II-15 ($2.15\times10^{-3}$ mol/l) and bleach accelerating agent "ATT" ($1.5\times10^{-2}$ mol/l). The following TABLE VII shows the films that were processed and the resulting residual silver from practice of the present invention. All of the films were acceptably processed using the present invention.

TABLE VII

| Film Processed | Residual silver (mg/m$^2$) |
|---|---|
| KODAK PROFESSIONAL EKTACHROME Film E100S (5089) | 2.27 |
| KODAK EKTACHROME 400X Professional Film (5075) | 4.70 |
| Fuji Photo SENSIA Film | 3.70 |
| Fuji Photo PROVIA Film | 3.88 |
| Fuji Photo VELVIA Film | 1.79 |
| AGFA RSX-100 Film | 0.92 |

EXAMPLE 5

A concentrated prebleaching composition of the present invention was prepared by mixing the following components in water and stirring until they had dissolved, then diluting with water to a volume of 200 ml:

| Component | Grams/liter | Final Concentrate Concentration (mol/liter) |
|---|---|---|
| Formaldehyde (37%) | 36.3 | 2.20 |
| Sodium metabisulfite | 42.7 | 1.15 |
| Potassium sulfite (45%) | 29.1 | 2.05 |
| Ethylenediaminetetraacetic acid (EDTA) | 5.00 | 0.085 |
| Phosphoric acid (75%) | 1.18 | 0.040 |
| Dye stain reducing agent (Compound II-15) | 2.0 | 0.108 |
| Bleach accelerating agent ("ATT") | 2.04 | 0.0766 |

This concentrated composition was used to make a working strength prebleaching composition of this invention by adding enough water to provide 1 liter of solution. Thus, the concentrate was diluted about 5 times. This working strength composition was used to process samples of the same films described in Example 4 above using the standard Process E-6 processing solutions and conditions for the other processing steps. Suitable color positive images were obtained and the residual silver was at about the same levels as shown in Example 4.

EXAMPLE 6

The preferred working strength prebleaching composition of this invention and the current KODAK Prebleach II, Process E-6 were tested for resistance to aerial oxidation. The prebleaching composition of this invention contained dye stain reducing agent Compound II-15 (0.00215 mol/l) and bleach accelerating agent "ATT" (0.015 mol/l).

Air was bubbled through a 1-liter sample of each solution at a rate of 25 ml/minute. At various times after aeration had begun, the solutions were tested for their bleach accelerating activity by using them to process uniformly exposed samples of KODAK PROFESSIONAL EKTACHROME Film E100S using otherwise standard Process E-6 processing solutions and conditions. The film samples were then analyzed for residual silver. As the prebleaching composition loses bleach accelerating activity because of oxidation, the amount of residual silver increases in the processed films. The results of these experiments are shown in the following TABLE VIII. The prebleaching composition of this invention is more stable to aerial oxidation than the standard Process E-6 composition.

TABLE VIII

| Time of Aeration (days) | Residual Silver ($mg/m^2$) for Standard Prebleaching | Residual silver ($mg/m^2$) for Invention Prebleaching |
|---|---|---|
| 3 | 1.87 | 2.34 |
| 10 | 12.4 | 8.1 |
| 17 | 25.1 | 9.66 |

EXAMPLE 7

Conditioning Composition

A working strength conditioning composition of the present invention was prepared by dissolving the following components in water in the noted amounts. All of the components readily dissolved to provide a clear, pale yellow solution.

| Component | Grams/liter | Concentration (mol/liter) |
|---|---|---|
| Potassium sulfite (45%) | 10.8 | 0.068 |
| Ethylenediaminetetraacetic acid (EDTA) | 8.0 | 0.027 |
| Dye stain reducing agent (Compound II-15) | 2.0 | 0.00215 |
| Bleach accelerating agent ("ATT") | 2.0 | 0.015 |
| Potassium hydroxide to make final pH of 6.15 | | |

The invention has been described in detail with particular reference to preferred embodiments thereof, but it will be understood that variations and modifications can be effected within the spirit and scope of the invention.

We claim:

1. A photographic prebleach or conditioning processing composition consisting essentially of:

a) at least 0.0001 mol/l of a cyclic mercapto bleach accelerating agent, and b) at least 0.0001 mol/l of a water-soluble or water-dispersible 2,6-diarylaminotriazine or diaminostilbene dye stain reducing agent, the amounts of said dye stain reducing agent and said bleach accelerating agent being determined according to the following equation:

[bleach accelerating agent, mol/l]≧0.01−10[dye stain reducing agent, mol/l].

2. The composition of claim 1 further comprising a formaldehyde precursor.

3. The composition of claim 2 that is in aqueous form and has a pH of from about 4 to about 8, and said cyclic mercapto bleach accelerating agent is present in an amount of from about 0.0001 to about 0.05 mol/l, said formaldehyde precursor is present in an amount of from about 0.05 to about 1 mol/l, and said dye stain reducing agent is present in an amount of from about 0.0001 to about 0.01 mol/l.

4. The composition of claim 2 wherein said formaldehyde precursor is an N-methylol compound, sodium formaldehyde bisulfite, or hexamethylenetetramine.

5. The composition of claim 4 wherein said formaldehyde precursor is sodium formaldehyde bisulfite.

6. The composition of claim 1 wherein said dye stain reducing agent is a 2,6-diarylaminotriazine represented by the following Structure II:

II

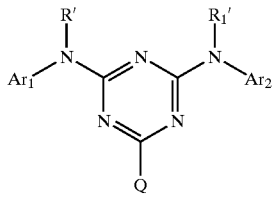

wherein $Ar_1$ and $Ar_2$ are independently carbocyclic or heterocyclic aromatic groups comprising at least 2 solubilizing groups on one or both aromatic groups, Q is hydrogen, hydroxy, thiol, carboxy, sulfo, a —$NR_2'R_3'$ group, a —$OR_2'$ group or a halo group, R' and $R_1'$ are independently hydrogen, an alkyl group having 1 to 3 carbon atoms or a hydroxyalkyl group having 1 to 3 carbon atoms, and $R_2'$ and $R_3'$ are independently hydrogen, an alkyl group, or a phenyl group.

7. The composition of claim 6 wherein said solubilizing groups include one or more sulfo, carboxy, hydroxy, sulfonamido or carbonamido groups, and $Ar_1$ and $Ar_2$ are independently carbocyclic aromatic groups.

8. The composition of claim 6 wherein R' and $R_1'$ are independently hydrogen, methyl or hydroxymethyl.

9. The composition of claim 7 wherein $Ar_1$ and $Ar_2$ are each naphthyl, said solubilizing groups are sulfo, and Q is hydrogen, hydroxy, sulfo or a halo group.

10. The composition of claim 1 wherein said dye stain reducing agent is one or more of the following Compounds II-1 through II-17:

II-1

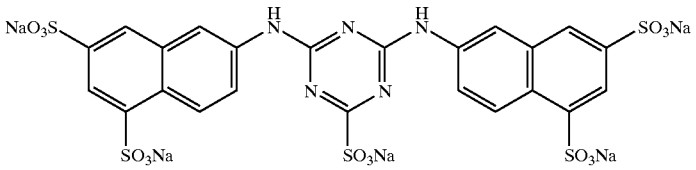

-continued
II-2
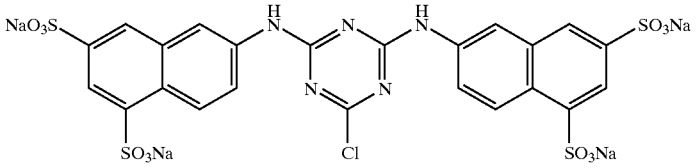
II-3
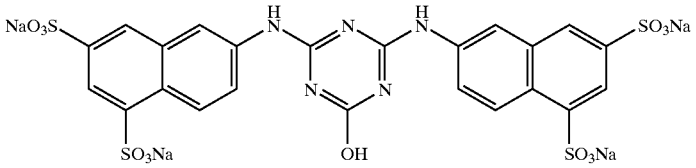
II-4
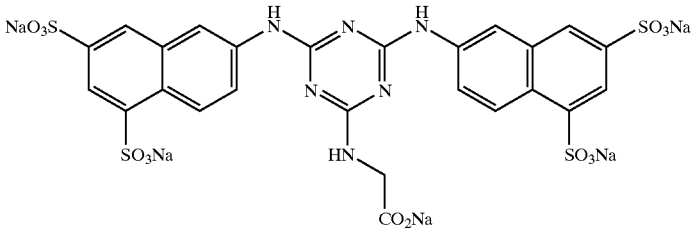
II-5
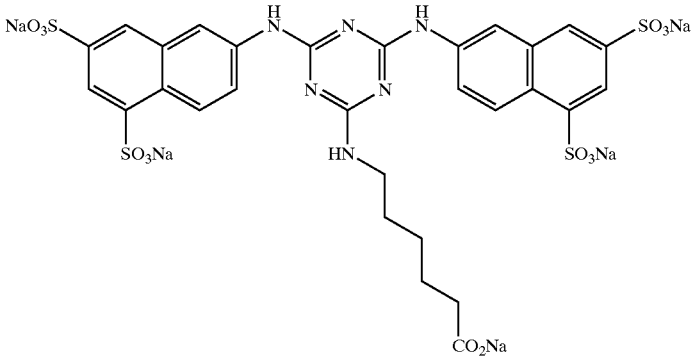
II-6
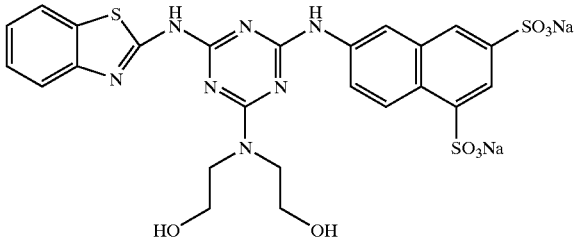
II-7
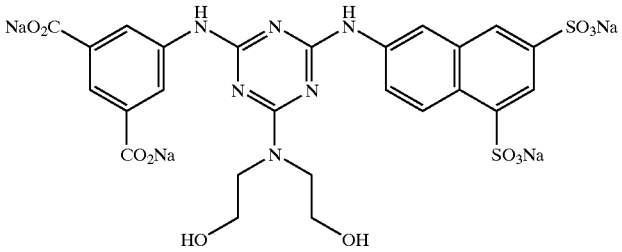

-continued
II-8
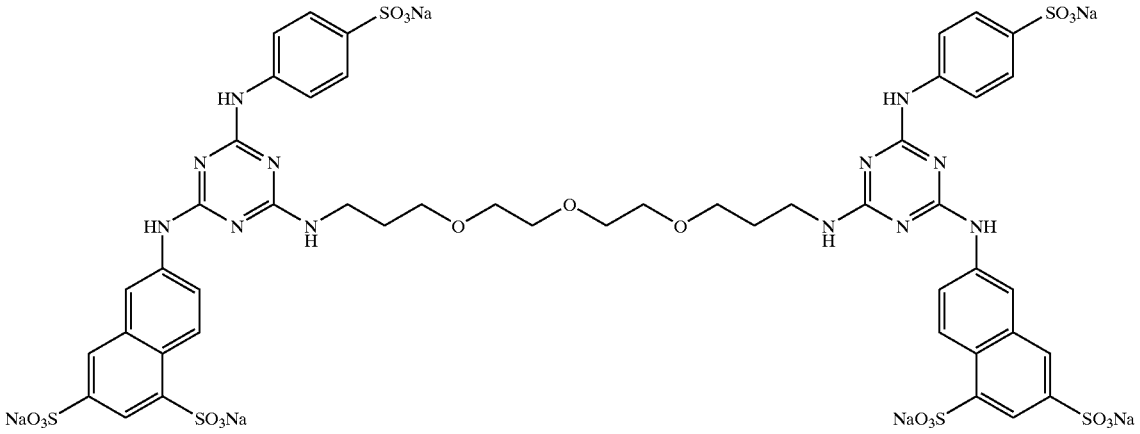
II-9
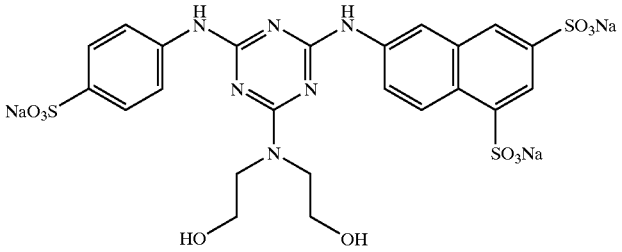
II-10
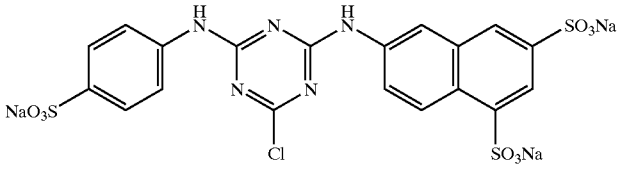
II-11
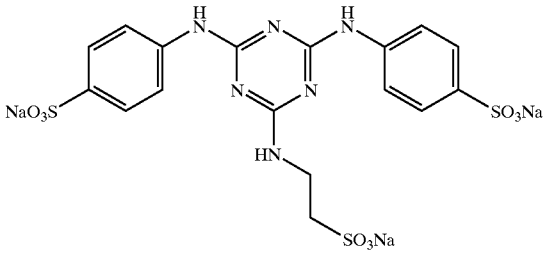
II-12
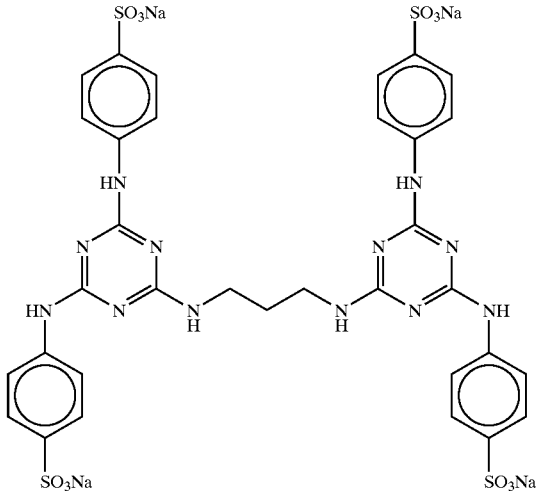

-continued
II-13
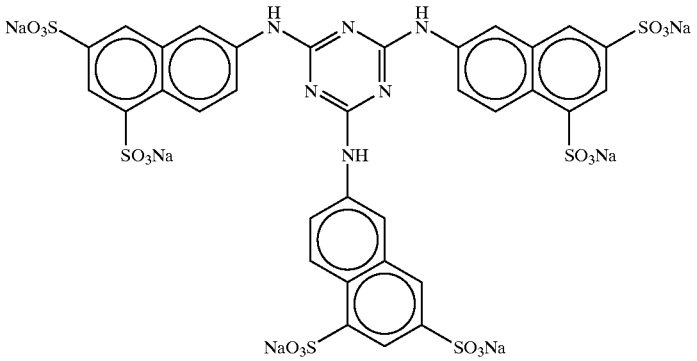
II-14
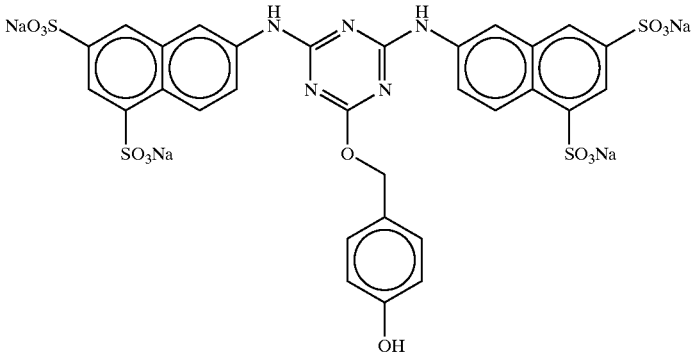
II-15
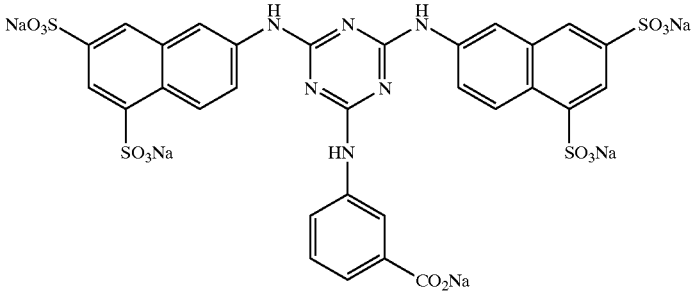
II-16
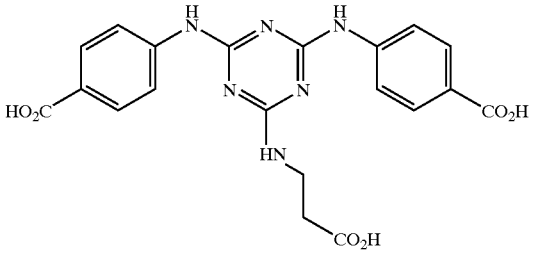
II-17
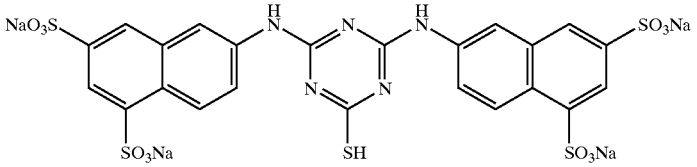
11. The composition of claim 6 wherein said dye stain reducing agent is represented by the following Structure IIa:

IIa
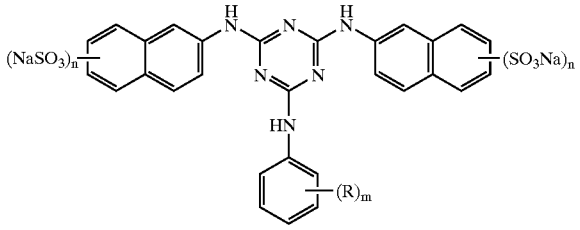
wherein R is carboxy (or salt thereof) or sulfo (or salt thereof), m is an integer of from 0 to 5, and n is an integer of from 2 to 7.
12. The composition of claim 11 wherein said dye stain reducing agent is one or more of the following Compounds IIa-1 to IIa-7:
IIa-1
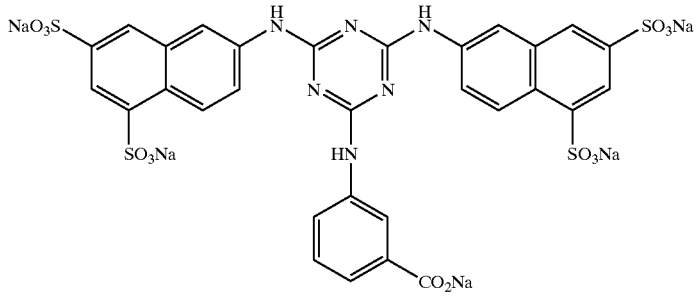
IIa-2
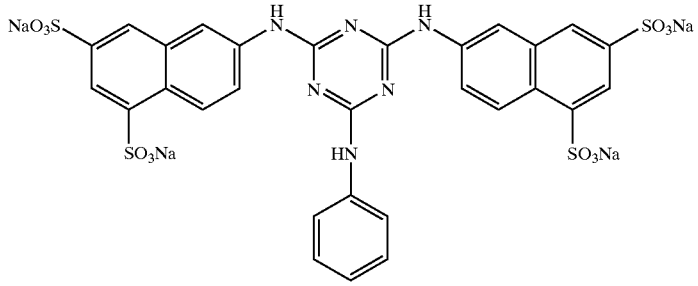
IIa-3
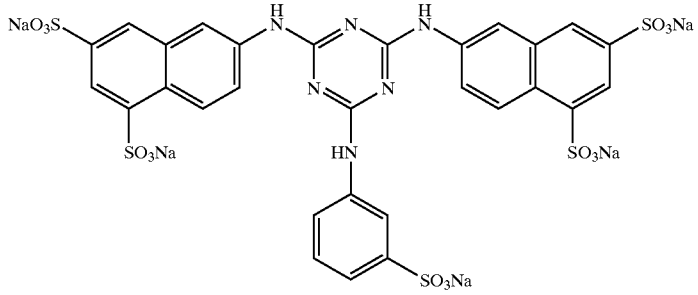
IIa-4
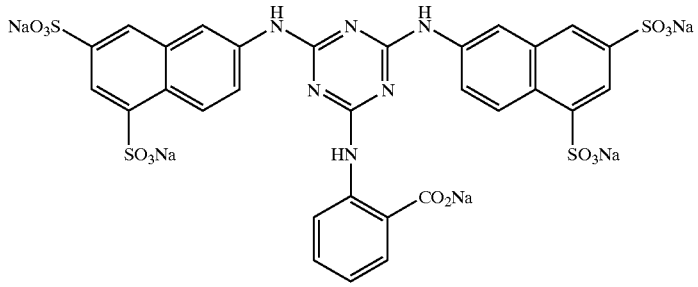

-continued

IIa-5

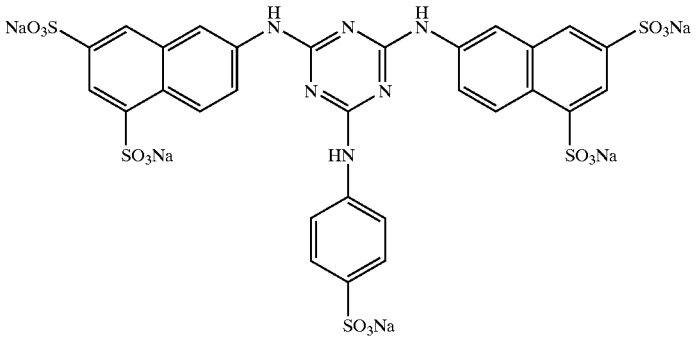

IIa-6

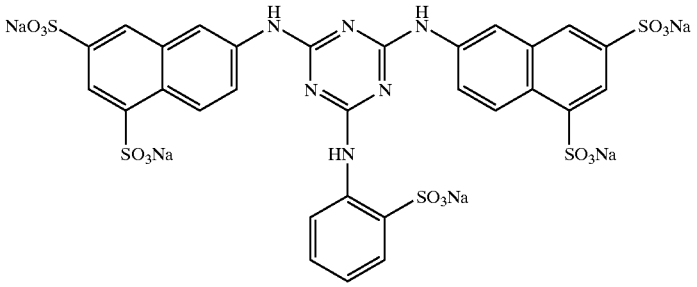

IIa-7

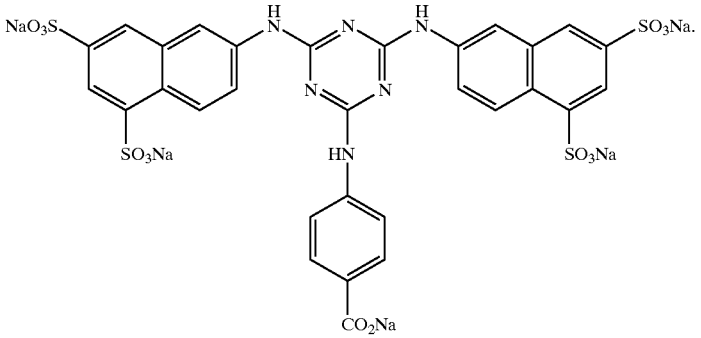

13. The composition of claim 1 wherein said dye stain reducing agent is a diaminostilbene represented by the following Structure I:

I

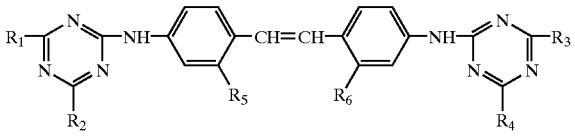

wherein $R_1$, $R_2$, $R_3$ and $R_4$ are independently hydroxy, halo, a morpholino group, an aryl group, an alkoxy group, an aryloxy group, an alkyl group, an amino group, an alkylamino group, or an arylamino group, $R_5$ and $R_6$ are independently hydrogen or sulfo, provided at least one of $R_5$ and $R_6$ is sulfo.

14. The composition of claim 13 wherein each of $R_5$ and $R_6$ is sulfo, and $R_1$, $R_2$, $R_3$ and $R_4$ are independently an alkoxy group, an alkylamino group, or an arylamino group.

15. The composition of claim 1 wherein said dye stain reducing agent is one or both of the following Compounds I-1 and I-2:

I-1

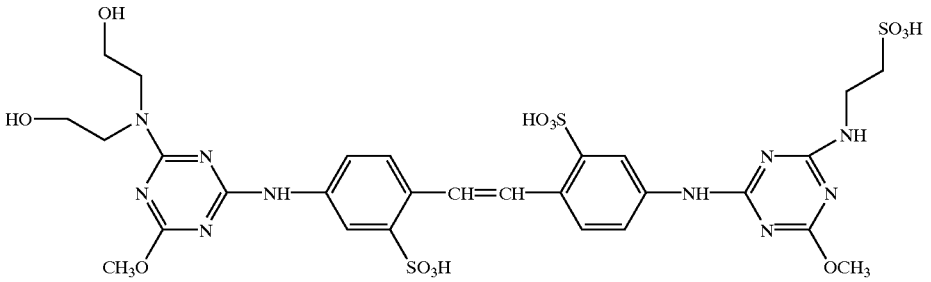

and

I-2

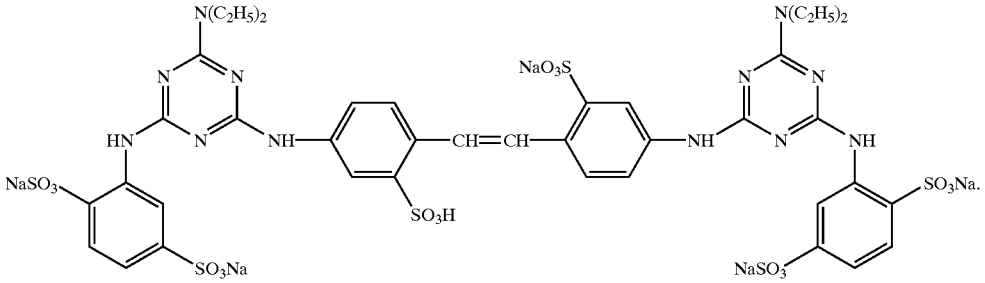

16. The composition of claim 1 wherein said cyclic mercapto bleach accelerating agent is represented by the following Structure III:

III

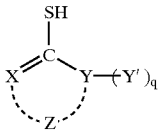

wherein X is a —CH— group or a nitrogen atom, Y is a carbon, nitrogen, oxygen, or sulfur atom, Y' is hydrogen or any substituent group, q is 0 or 1, and Z represents the carbon, nitrogen, and oxygen atoms necessary to complete a 5- to 7-membered, substituted or unsubstituted heterocyclic ring.

17. The composition of claim 16 wherein Y is nitrogen or sulfur, and Z represents the carbon, nitrogen, and oxygen atoms necessary to complete a 5- to 6-membered heterocyclic ring.

18. The composition of claim 1 wherein said cyclic mercapto bleach accelerating agent is one or more of mercaptotriazole (MT), 5-amino-1,3,4-thiadiazole-2(3H)-thione (ATT), o-mercaptobenzoic acid (MBA), and tetrahydro-5-(2-hydroxyethyl)-1,3,5-triazine-2(1H)-thione (HTTT).

19. A concentrated photographic prebleach or conditioning processing composition consisting essentially of:

a) at least 0.0002 mol/l of a cyclic mercapto bleach accelerating agent, and b) at least 0.0002 mol/l of a water-soluble or water-dispersible 2,6-diarylaminotriazine or diaminostilbene dye stain reducing agent, the amounts of said dye stain reducing agent and said bleach accelerating agent being determined according to the following equation:

[bleach accelerating agent, mol/l]≧0.01−10[dye stain reducing agent, mol/l].

20. The concentrated processing composition of claim 19 further comprising a formaldehyde precursor.

21. A photographic processing kit comprising:

I) a photographic prebleach or conditioning processing composition consisting essentially of:

a) at least 0.0001 mol/l of a cyclic mercapto bleach accelerating agent, and b) at least 0.0001 mol/l of a water-soluble or water-dispersible 2,6-diarylaminotriazine or diaminostilbene dye stain reducing agent, the amounts of said dye stain reducing agent and said bleach accelerating agent being determined according to the following equation:

[bleach accelerating agent, mol/l]≧0.01−10[dye stain reducing agent, mol/l], and II) one or more of a photographic color developing composition, a photographic bleaching composition, a photographic bleach-fixing composition, a photographic fixing composition, a photographic reversal composition, a black-and-white developing composition, and a dye stabilizing and/or final rinse composition.

22. A method for providing a positive color photographic image comprising contacting an imagewise exposed and color developed, color reversal photographic silver halide material with a photographic prebleach or conditioning processing composition consisting essentially of:

a) at least 0.0001 mol/l of a cyclic mercapto bleach accelerating agent, and b) at least 0.0001 mol/l of a water-soluble or water-dispersible 2,6-diarylaminotriazine or diaminostilbene dye stain reducing agent, the amounts of said dye stain reducing agent and said bleach accelerating agent being determined according to the following equation:

[bleach accelerating agent, mol/l]≧0.01−10[dye stain reducing agent, mol/l].

23. The method of claim 22 wherein said color reversal photographic silver halide material is contacted with a photographic bleaching or bleach-fixing composition after said contacting with said photographic prebleach or conditioning processing composition.

24. A method for providing a color positive image comprising the following steps, in order:

A) contacting an imagewise exposed color reversal photographic silver halide material with a black-and-white developing composition, B) contacting said color reversal photographic silver halide material with a reversal composition, C) color developing said color reversal photographic silver halide material with a photographic color developing composition, D) contacting said color reversal photographic silver halide material with a photographic prebleach or conditioning processing composition having a pH of from about 4 to about 8 and consisting essentially of:

a) from about 0.0001 to about 0.05 mol/l of a cyclic mercapto bleach accelerating agent that is represented by the following Structure III:

III

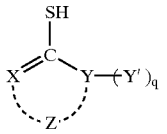

wherein X is a —CH— group or a nitrogen atom, Y is a carbon, nitrogen, oxygen, or sulfur atom, Y' is hydrogen or any substituent group, q is 0 or 1, and Z represents the carbon, nitrogen, and oxygen atoms necessary to complete a 5- to 7-membered, substituted or unsubstituted heterocyclic ring, b) from about 0.05 to about 1 mol/l of sodium formaldehyde bisulfite, and c) from about 0.0001 to about 0.01 mol/l of a water-soluble or water-dispersible 2,6-diarylaminotriazine dye stain reducing agent that is represented by the following Structure II:

II

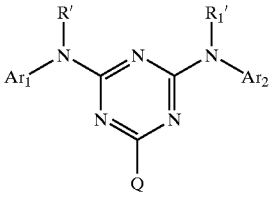

wherein $Ar_1$ and $Ar_2$ are independently carbocyclic or heterocyclic aromatic groups comprising at least 2 solubilizing groups on one or both aromatic groups, Q is hydrogen, hydroxy, thiol, carboxy, sulfo, a —$NR_2'R_3'$ group, a —$OR_2'$ group or a halo group, R' and $R_1'$ are independently hydrogen, an alkyl group having 1 to 3 carbon atoms or a hydroxyalkyl group having 1 to 3 carbon atoms, and $R_2'$ and $R_3'$ are independently hydrogen, an alkyl group, or a phenyl group, or a diaminostilbene dye stain reducing agent represented by the following Structure I:

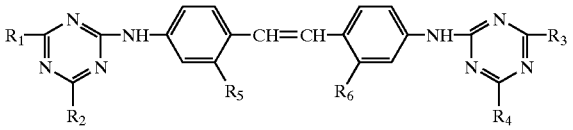

wherein $R_1$, $R_2$, $R_3$ and $R_4$ are independently hydroxy, halo, a morpholino group, an aryl group, an alkoxy group, an aryloxy group, an alkyl group, an amino group, an alkylamino group, or an arylamino group, $R_5$ and $R_6$ are independently hydrogen or sulfo, provided at least one of $R_5$ and $R_6$ is sulfo, the amounts of said bleach accelerating agent and said dye stain reducing agent being determined according to the following equation:

[bleach accelerating agent, mol/l]≧0.01−10[dye stain reducing agent, mol/l],

E) bleaching and fixing said color reversal photographic silver halide material with photographic bleaching and fixing compositions in separate steps, or bleach-fixing said color reversal photographic silver halide material with a photographic bleach-fixing composition, and F) dye stabilizing and/or rinsing said color reversal photographic silver halide material with a photographic dye stabilizing and/or rinsing composition.

25. The method of claim 24 wherein said cyclic mercapto bleach accelerating agent is 5-amino-1,3,4-thiadiazole-2 (3H)-thione (ATT), and said dye stain reducing agent is Compound II-15

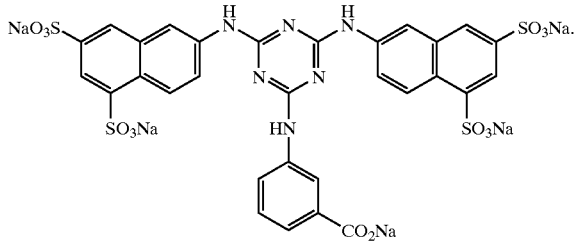

* * * * *